US007995020B2

(12) United States Patent
Yamazaki et al.

(10) Patent No.: US 7,995,020 B2
(45) Date of Patent: Aug. 9, 2011

(54) DISPLAY APPARATUS AND DISPLAY METHOD

(75) Inventors: Tatsuro Yamazaki, Tokyo (JP); Makiko Mori, Kanagawa (JP); Osamu Sagano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 916 days.

(21) Appl. No.: 10/913,329

(22) Filed: Aug. 9, 2004

(65) Prior Publication Data

US 2005/0007328 A1 Jan. 13, 2005

Related U.S. Application Data

(62) Division of application No. 09/988,108, filed on Nov. 19, 2001, now Pat. No. 6,842,160.

(30) Foreign Application Priority Data

Nov. 21, 2000 (JP) ..... 2000-354835

(51) Int. Cl.
*G09G 3/36* (2006.01)

(52) U.S. Cl. ..... 345/89

(58) Field of Classification Search ..... 345/63, 345/74.1, 83, 89, 94, 100, 104
See application file for complete search history.

(56) References Cited

U.S. PATENT DOCUMENTS

| | | | | |
|---|---|---|---|---|
| 4,750,813 | A * | 6/1988 | Ohwada et al. | 345/87 |
| 4,760,387 | A * | 7/1988 | Ishii et al. | 345/3.1 |
| 5,594,463 | A * | 1/1997 | Sakamoto | 345/76 |
| 5,734,361 | A | 3/1998 | Suzuki et al. | 345/74 |
| 5,940,053 | A | 8/1999 | Ikeda | 345/77 |
| 6,091,381 | A | 7/2000 | Uenuma | 345/74.1 |
| 6,121,942 | A | 9/2000 | Sanou et al. | 345/75.1 |
| 6,215,466 | B1 | 4/2001 | Yamazaki et al. | 345/89 |
| 6,653,794 | B2 | 11/2003 | Sagano et al. | 315/169.2 |
| 2003/0006976 | A1 | 1/2003 | Sagano | 345/690 |

FOREIGN PATENT DOCUMENTS

| | | |
|---|---|---|
| JP | 8-248920 | 9/1996 |
| JP | 09-134145 | 5/1997 |
| JP | 2000-242208 | 9/2000 |

* cited by examiner

*Primary Examiner* — Sumati Lefkowitz
*Assistant Examiner* — Tammy Pham
(74) *Attorney, Agent, or Firm* — Fitzpatrick, Cella, Harper & Scinto

(57) ABSTRACT

For decreasing hardware for correction to compensate for decrease of luminance due to decrease in drive voltage of devices, a plurality of electron-emitting devices are arranged in a matrix pattern and wired by a plurality of row and column lines, a column wiring driving unit applies voltage pulses to the column lines, and row wiring driving units apply voltages to the row lines to switch a row to be selected. The image signal processing unit divides a luminance level of an image signal into plural areas in the signal amplitude direction in response to each split timing signal. There are provided means for detecting frequencies of luminance signals included in the respective amplitude areas, a correction quantity calculating unit for outputting correction signals based on the detected values, and an adding unit for adding the correction signals and luminance signals, which outputs results of addition as electron emission requirements to the column wiring driving unit.

2 Claims, 16 Drawing Sheets

$$IL(1)=(r*4/5)*i1 \quad IR(1)=(r*1/5)*i1$$
$$IL(2)=(r*3/5)*i2 \quad IR(2)=(r*2/5)*i2$$
$$IL(3)=(r*2/5)*i3 \quad IR(3)=(r*3/5)*i3$$
$$IL(4)=(r*1/5)*i4 \quad IR(4)=(r*4/5)*i4$$

$$\Delta VA=r*\sum_{k=1}^{4}(IL(k))$$
$$\Delta VB=\Delta VA+r*(\sum_{k=2}^{4}(IL(k))-\sum_{k=1}^{1}(IR(k)))$$
$$\Delta VC=\Delta VB+r*(\sum_{k=3}^{4}(IL(k))-\sum_{k=1}^{2}(IR(k)))$$
$$\Delta VD=\Delta VC+r*(\sum_{k=4}^{4}(IL(k))-\sum_{k=1}^{3}(IR(k)))$$

FIG. 6

(1)

| | PERIOD I | PERIOD II | PERIOD III |
|---|---|---|---|
| X1 VOLTAGE OUTPUT | ON | ON | ON |
| X2 VOLTAGE OUTPUT | ON | ON | OFF |
| X3 VOLTAGE OUTPUT | ON | OFF | OFF |
| X4 VOLTAGE OUTPUT | OFF | OFF | OFF |

(2)

| | PERIOD I | PERIOD II | PERIOD III | TOTAL OF ONE HORIZONTAL SCANNING INTERVAL |
|---|---|---|---|---|
| VOLTAGE DROP AT POINT A | ΔVA(I) | ΔVA(II) | ΔVA(III) | (ΔVA(I)+(ΔVA(II)+(ΔVA(III))/3 |
| VOLTAGE DROP AT POINT B | ΔVB(I) | ΔVB(II) | ΔVB(III) | (ΔVB(I)+(ΔVB(II)+(ΔVB(III))/3 |
| VOLTAGE DROP AT POINT C | ΔVC(I) | ΔVC(II) | ΔVC(III) | (ΔVC(I)+(ΔVC(II)+(ΔVC(III))/3 |
| VOLTAGE DROP AT POINT D | ΔVD(I) | ΔVD(II) | ΔVD(III) | (ΔVD(I)+(ΔVD(II)+(ΔVD(III))/3 |

| | DATA'S GREATER THAN Vref 1 | DATA'S GREATER THAN Vref 2 | DATA'S GREATER THAN Vref 3 |
|---|---|---|---|
| BLOCK I | NA 1 | NA 2 | NA 3 |
| BLOCK II | NB 1 | NB 2 | NB 3 |
| BLOCK III | NC 1 | NC 2 | NC 3 |
| BLOCK IV | ND 1 | ND 2 | ND 3 |

| CORRECTION DATA | OUTPUT |
|---|---|
| 00B | V1 |
| 01B | V2 |
| 10B | V3 |
| 11B | V4 |

PRIOR ART

DISPLAY APPARATUS AND DISPLAY METHOD

This application is a division of application Ser. No. 09/988,108, filed Nov. 19, 2001.

BACKGROUND OF THE INVENTION

1. Field of the Invention

The present invention relates to display apparatus provided with a plurality of image forming devices such as electron-emitting devices, EL devices, or the like wired in a matrix pattern and, more particularly, to a signal processing unit for driving devices while compensating for decrease in drive quantity of cold-cathode devices due to an electric resistance component of matrix wiring and the like of a display panel, in display apparatus such as television receivers, display devices, or the like configured to receive television signals or display signals from a computer or the like and display an image, using a display panel consisting of cold-cathode electron-emitting devices and a fluorescent screen for emitting light under irradiation with electron beams.

2. Related Background Art

As an example of the conventional display apparatus, for example, Japanese Patent Application Laid-Open No. 8-248920 discloses a configuration for effecting such correction as to compensate for decrease of luminance caused by decrease in drive voltage of devices due to the electric resistance component of electrical connection wiring and the like to the electron-emitting devices, which is configured to calculate correction amounts thereof by statistical computation and combine the correction amounts with electron beam requirements.

FIG. 17 shows a block diagram of the display apparatus described as the first embodiment in the Japanese Patent Application Laid-Open No. 8-248920. Since the details are described in the application, the detailed description thereof is not provided herein, but it proposes the configuration to multiply luminance data by correction data from memory means 207 by means of multipliers 208 provided for respective column lines and transfer corrected data to modulated signal generator 209.

The above conventional configuration, however, necessitated large-scale hardware such as the multipliers for the respective column lines, the memory means for supplying the correction data, and an adder for feeding an address signal to the memory means.

SUMMARY OF THE INVENTION

An object of the present invention is to provide display apparatus and a display method capable of implementing such correction as to compensate for the decrease of luminance caused by the decrease in drive voltage of devices due to the electric resistance component of the electrical connection wiring and the like, by smaller-scale hardware than in the display apparatus of the conventional example.

In order to accomplish the above object, a first aspect of the present invention is directed to a display apparatus comprising: electron emission elements aligned in a matrix on a substrate and driven by column lines and row lines; a column line drive unit for driving the column lines in a pulse width modulation manner by applying to each column line one of pulses which have different pulse widths respectively corresponding to gradation levels of a luminance signal to be displayed in the display apparatus; a row line drive unit for sequentially driving the row lines; first means for defining a plurality of blocks each of which includes at least one column line by dividing the column lines and a plurality of gradation steps each of which includes at least one gradation level by dividing the gradation levels, and detecting a block driving status which indicates how the gradation levels in each of the gradation steps are applied to the columns in each block; and second means for defining a plurality of periods within one horizontal interval, the periods being associated with widths of approximating pulses corresponding respectively to the gradation steps, calculating a voltage drop due to a resistance in the row line and the current flow by the approximating pulses on the column lines during each of the defined periods on the basis of the detected block driving status, determining a block voltage drop for each block estimated from the voltage drops over the plurality of periods, and modifying the luminance signal for each block according to the determined block voltage drop.

In order to accomplish the above object, a second aspect of the present invention is directed to a method of driving display apparatus comprising electron emission elements aligned in a matrix on a substrate and driven by column lines and row lines, a column line drive unit for driving the column lines in a pulse width modulation manner by applying to each column line one of pulses which have different pulse widths respectively corresponding to gradation levels of a luminance signal to be displayed in the display apparatus and a row line drive unit for sequentially driving the row lines, comprising the steps of: calculating a voltage drop due to a resistance in the row line and the current flow by the pulse widths on the column lines; and modifying the luminance signal according to the calculated voltage drop so that for the same luminance data, a width of a pulse applied to a column line is longer as the column line is aligned more distant from the row line drive unit.

BRIEF DESCRIPTION OF THE DRAWINGS

FIG. 6 shows (1) a table indicating an example of acquisition of a table memory in FIG. 3 and FIG. 5 and (2) a table indicating an example of calculation of the voltage drops upon pulse width modulation in the example of FIG. 3;

DETAILED DESCRIPTION OF THE PREFERRED EMBODIMENTS

First Embodiment

Figure 1:
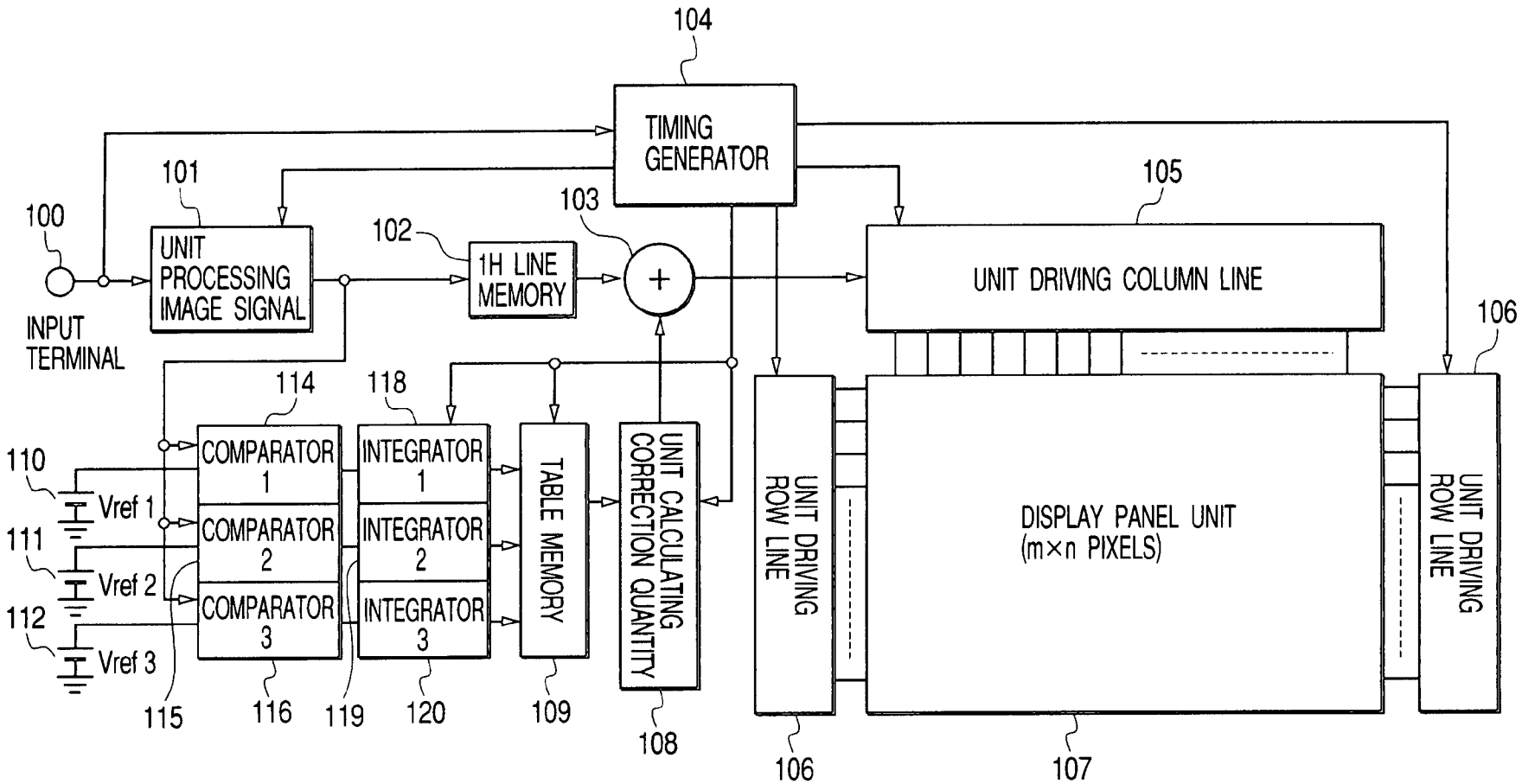
FIG. 1 is a block diagram showing a display apparatus according to the first embodiment of the present invention.

FIG. 1 is a block diagram to show the display apparatus according to the first embodiment of the present invention. In this figure, a display panel unit 107 is comprised of a multi-electron source in which surface conduction electron-emitting devices (hereinafter abbreviated as SCE) being electron-emitting devices are arranged in a matrix of (m×n), and a fluorescent screen as a photoreceptive surface for emitting light under irradiation with electron beams from the multi-electron source. Although not shown, a high voltage bias for accelerating emitted electron beams is applied to the fluorescent screen. Since Japanese Patent Application Laid-Open No. 8-248920 describes the production method of the display panel unit 107 in detail, the description thereof is omitted herein by incorporating it by reference.

As detailed in No. 8-248920, there are some conceivable methods of controlling emission luminance gradations of the display panel using the SCEs. The present embodiment will be described hereinafter as an example based on the premise that the column line driving unit 105 applies to the column lines voltage pulses with pulse widths proportional to input luminance data, i.e., electron emission requirement data and the row line driving units 106 apply a select voltage pulse to each line to implement emission of light and sequentially scans the rows to be selected, thereby implementing display of imagery. In this method wherein ON times of the SCEs are proportional to the electron emission requirement data, the times for the fluorescent screen of the display panel to accept electrons are proportional to the electron emission requirement data, so that emission luminances are also approximately proportional to the electron emission requirement data.

Figure 5:
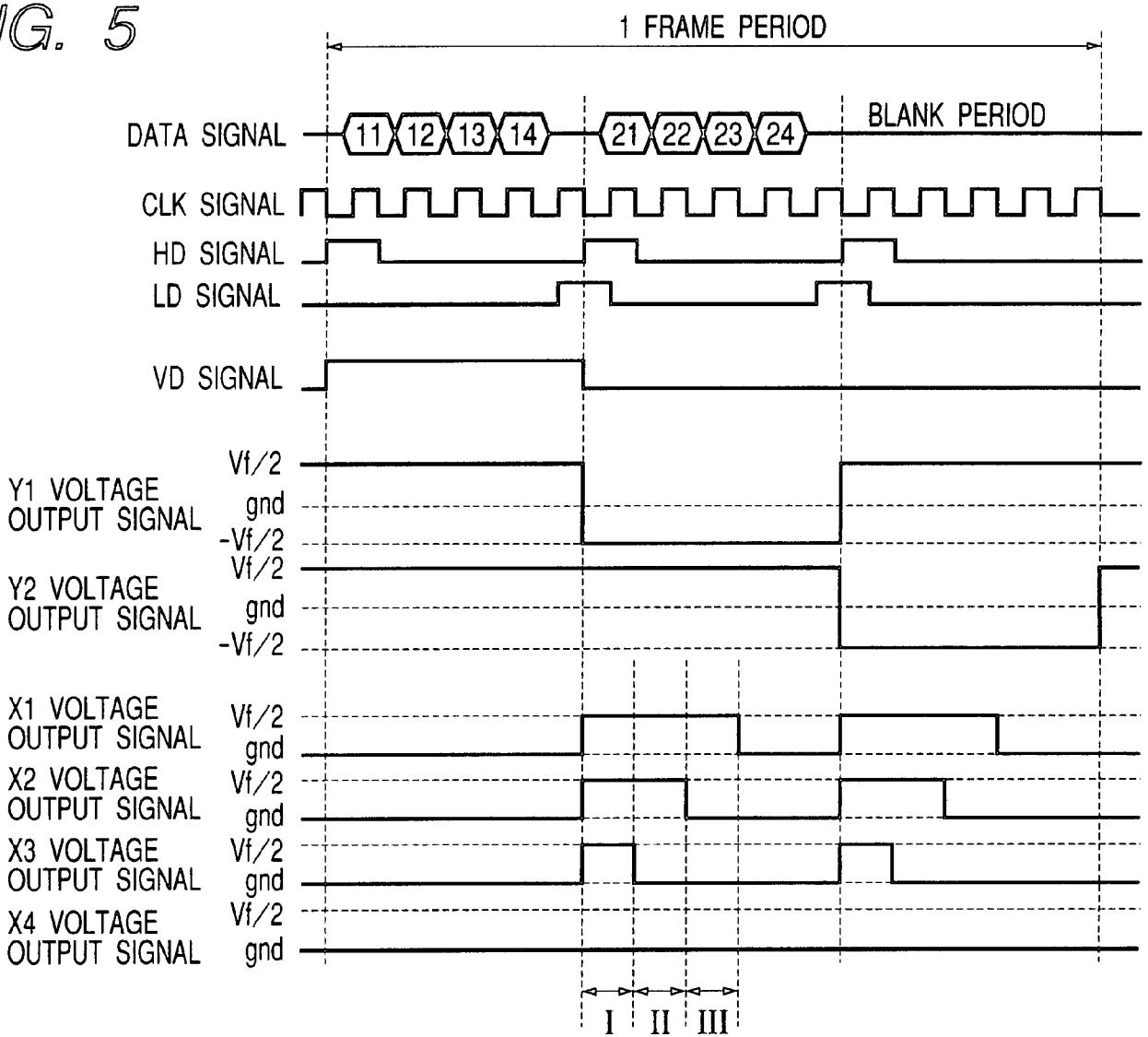
FIG. 5 is a time chart showing the operation timing of each unit in FIG. 3.

As a simple example, let us consider a case wherein the display panel unit 107 according to the present embodiment comprises eight SCEs 11 to 14, 21 to 24 arranged in a matrix by four column lines and two row lines and is configured to effect display in two bits of gradation levels. FIG. 5 is a time chart showing the operation timing of each unit in FIG. 3.

Figure 3:
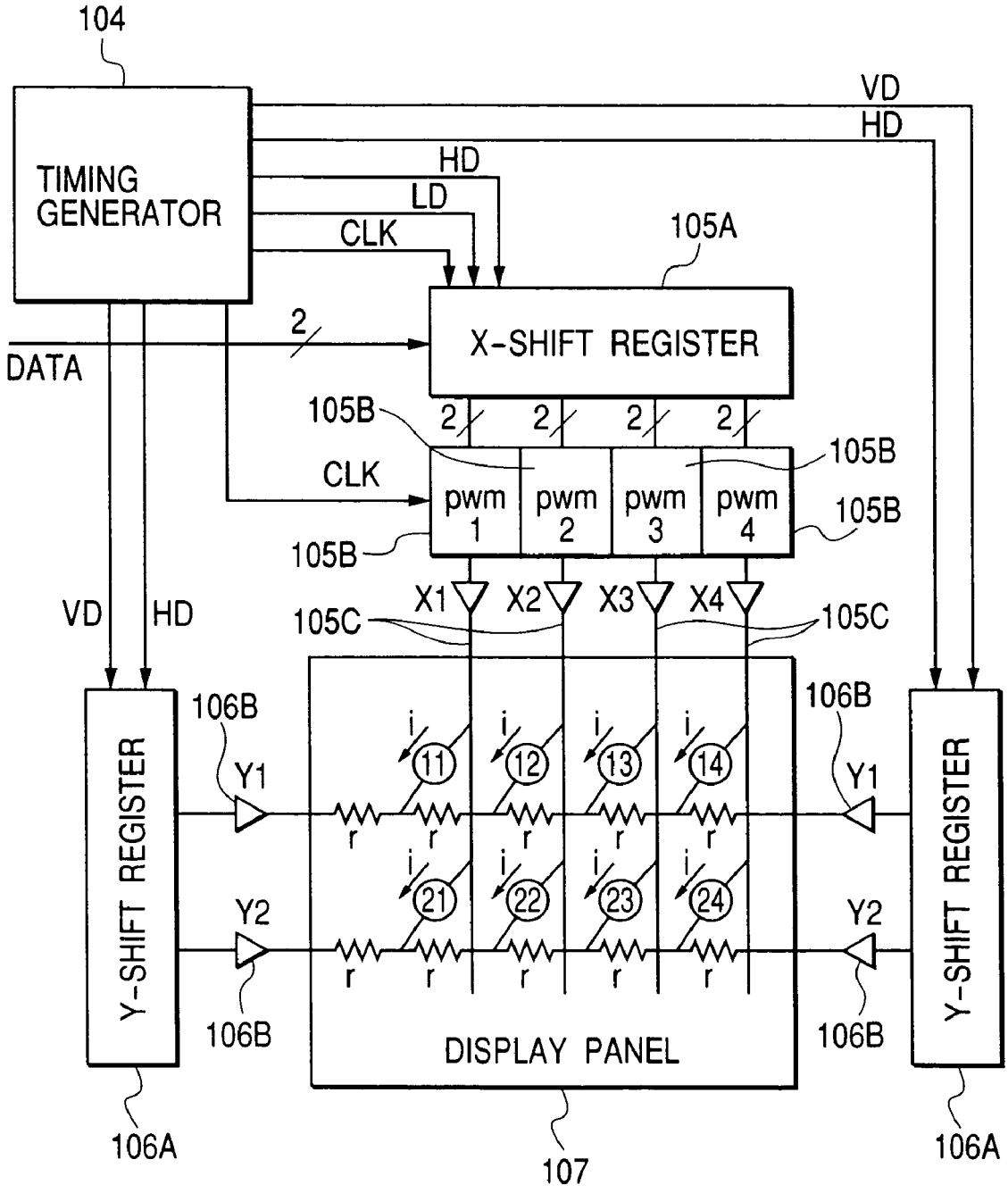
FIG. 3 is a block diagram for easily describing the structure and operation of the column line driving unit and the row line driving unit in the display apparatus according to the first embodiment of the present invention.

The column line driving unit 105 in FIG. 1 is comprised of an X-shift register 105A, pulse width modulators 105B provided for the respective column lines, and column line driving output units 105C in FIG. 3.

An input data signal into the X-shift register 105A is the luminance data, which includes electron emission requirements for the respective SCEs matrix-wired. This signal is fed in a dot sequential manner for every row, as indicated by DATA in FIG. 5. Since in this case the devices are arranged in the 2×4 matrix, four electron emission requirements for the respective SCEs in one row are transferred during one horizontal period. One frame consists of three horizontal periods, among which two horizontal periods are provided for data transmission and one horizontal period for a blank period.

The X-shift register 105A consists of four 2-bit registers connected in series and sequentially reads input data by a CLK (clock) signal sent from the timing generator 104. The data thus read into the X-shift register 105A is transferred to the pulse width modulators pwm 105B by an LD signal generated for every horizontal period. The pulse width modulators 105B generate voltage signals with pulse widths proportional to the transferred data. For example, each pulse width modulator 105B is composed of a data latch, a counter, and a flip-flop and is configured to set the flip-flop and start the counter by an HD signal, reset the flip-flop by a count end trigger of a data count retained in the latch, and use an output of the flip-flop as a pulse width signal. Each column line driving output unit 105C is arranged to amplify the output voltage signal from the pulse width modulator 105B up to a desired amplitude level and apply the amplified signal to the associated column line. In this example a select potential of each SCE is Vf, and the column line driving output units 105C generate voltage signals with a potential difference of Vf/2 from the ground level. In FIG. 5, X1 to X4 voltage output signals represent waveforms given when the electron emission requirements are 11B, 10B, 01B, and 00B, respectively (where B indicates binary data).

The row line driving units 106 in FIG. 1 are comprised of two Y-shift registers 106A provided left and right of the display panel unit 107, and row line driving output units 106B provided on the both sides of each row line in FIG. 3.

The Y-shift registers 106A are configured to shift a VD signal from the timing generator 104 by an HD signal and output a voltage pulse with an approximately one horizontal interval width to the row line driving output units 106B of the first row line in synchronism with a horizontal interval in which the column line driving output units 105C generate output voltage pulses for the first row line. Likewise, the Y-shift registers 106A are configured to output a voltage pulse to the row line driving output units 106B of the second row line in synchronism with the timing when the column line driving output units 105C generate output voltage pulses equivalent to the data of the second row line. In this manner, the timing pulses are generated for sequential scanning.

The row line driving output units 106B are configured to amplify the output voltage pulse signals from the Y-shift registers 106A up to a desired amplitude level and apply the amplified signals to the row lines. In this case, they generate voltage signals with a potential difference from −Vf/2 to Vf/2. FIG. 5 shows an example of the voltage signals as Y1 voltage output signal and Y2 voltage output signal.

FIGS. 3 and 5 show the example in which the number of emitter is very small for easier understanding of the operation, but the apparatus can also be basically implemented in like structure even with increase in the number of emitters.

In FIG. 1, an input terminal 100 represents an input unit for receiving input of an image signal from the outside, for an image to be displayed. Although not shown, in the case wherein the input image signal is fed in a compressed form of an original signal in order to transmit the image signal in a limited transmission band, the input terminal 100 includes a decoding means for expanding the compressed signal and decoding it to the original signal.

In an image signal processing unit 101, the image signal from the input terminal 100 is first sampled so as to fit the number of emitters and the pixel configuration of the display panel unit 107. Specifically, scanning line conversion is carried out (if necessary) so as to match the number of effective scanning lines in one frame period of the image signal from the input terminal 100 with the number of row lines of the display panel unit 107.

The luminance data in the number equal to the number of column lines is sampled from horizontal effective display intervals of the input signal. Where the fluorescent screen of the display panel unit 107 employs, for example, the three primary colors of red, green, and blue, the luminance data is arranged so as to match a color sequence thereof. The number of quantized bits of each image sample is determined according to the number of gradations that can be expressed by the display panel unit 107.

Since image signals are often based on the premise of display apparatus employing a CRT, γ-correction is often performed taking into consideration γ-characteristics of the CRT. Therefore, in case of a display panel of which light emitting luminance is approximately proportional to a data of required value of electron emission quantity, so-called inverse γ-correction is also performed within the image signal processing unit 101.

Correction quantity calculating unit 108 and adding means 103 are provided for performing such correction as to compensate for the decrease of luminance caused by the decrease (drop) in the drive voltage of the devices due to the electric resistance of the electrical connection wiring and the like to the devices in the display panel unit 107, and the adding means 103 adds a correction quantity calculated in the correction quantity calculating unit 108, to an output signal from the image signal processing unit 101, thereby generating corrected luminance data.

Figure 4:
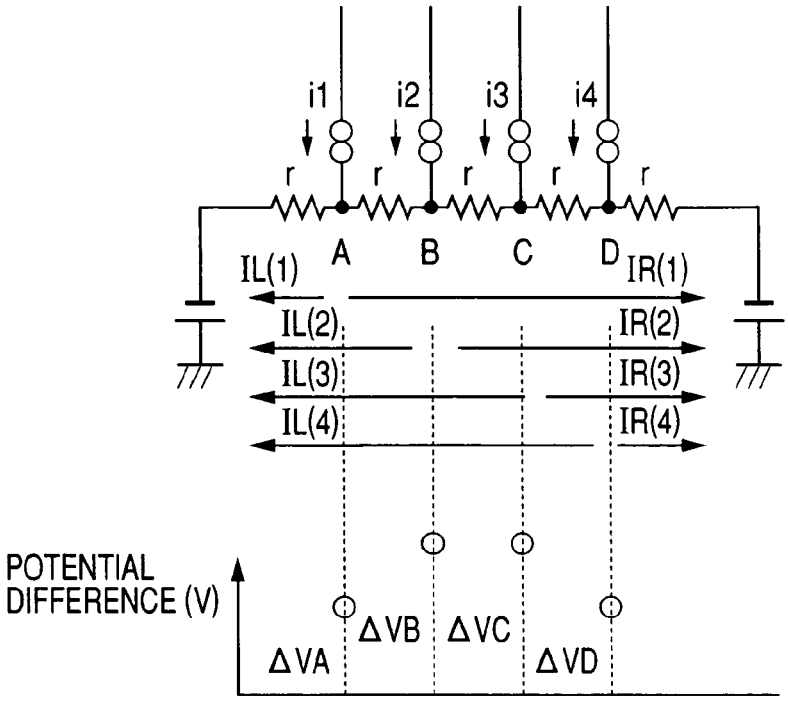
FIG. 4 is a diagram for explanation showing an example of calculation to calculate voltage drops appearing on the row lines in FIG. 3.

Let us explain an example of the calculation to calculate drive voltage decreases of the devices due to the electric resistance of connection wiring, using the example shown in FIG. 4.

When the first row is selected, drive currents i1 to i4 flow from the corresponding column line drivers X1 to X4 to the devices 11 to 14 disposed in the display panel unit 107.

When r indicates an electric resistance between connections of respective devices on the row line and when the both sides of the row line are selected by an equal potential as shown, a device current of the kth device (where k is a natural number of 1 to 4) is split into IL(k) and IR(k) at a ratio of resistances from a connection end to the row line (indicated by A, B, C, or D in FIG. 4) to the Y1 drivers on the both sides. The device currents are split as follows.

$$IL(1)=(r*4/5)*i1,\ IR(1)=(r*1/5)*i1$$

$$IL(2)=(r*3/5)*i2,\ IR(2)=(r*2/5)*i2$$

$$IL(3)=(r*2/5)*i3,\ IR(3)=(r*3/5)*i3$$

$$IL(4)=(r*1/5)*i4,\ IR(4)=(r*4/5)*i4$$

Namely, generated potential differences (voltage drops) ΔVA to ΔVD at the respective points A, B, C, and D on the row line are represented by (Eq. 1) below.

$$\Delta VA = r*\sum_{k=1}^{4}(IL(k)) \qquad \text{(Eq. 1)}$$

$$\Delta VB = \Delta VA + r*\left(\sum_{k=2}^{4}(IL(k)) - \sum_{k=1}^{1}(IR(k))\right)$$

-continued $$\Delta VC = \Delta VB + r*\left(\sum_{k=3}^{4}(IL(k)) - \sum_{k=1}^{2}(IR(k))\right)$$

$$\Delta VD = \Delta VC + r*\left(\sum_{k=4}^{4}(IL(k)) - \sum_{k=1}^{3}(IR(k))\right)$$

The drive voltages applied to the respective devices are decreased by the potential differences (voltage drops) generated on the row line, obtained in (Eq. 1) above, so as to cause reduction of luminance.

The above equation (1) shows the calculation manner in a case where row line drivers are arranged at both of opposite sides of the row lines. For a case where a row line drive is arranged at one side of the row lines, potential differences on the row line can be obtained in a similar calculation manner.

As disclosed in Japanese Patent Application Laid-Open No. 8-248920, there is the known property of relation of the device applied voltage (Vf) with the device drive current (If) and emission current (Ie), and thus a value of the device drive current (If) can become known when the applied voltage (Vf) is determined.

The electric resistances of the row lines of the display panel unit 107 are also fixed known values. Namely, where drive voltages (with an identical pulse width) are simultaneously applied to all the devices in one row line, decreases of the drive voltages (voltage drops) can be calculated by foregoing (Eq. 1), and it is thus feasible to calculate correction value data to be added to the luminance data in order to make correction for the luminance decreases caused by the voltage drops.

In practical driving states, however, the devices in one row line are rarely driven simultaneously by the same pulse width, but the devices are driven by pulse widths according to respective, different luminance data. In this case, generated voltage drops also vary according to the luminance data.

For example, considering it in the example shown in FIG. 4, there are four possible pulse widths according to the 2-bit luminance data. In this case, one horizontal scanning interval (except for periods corresponding to no image signal) is divided into periods I, II, and III, and generated voltage drops are calculated in the respective divisional periods according to foregoing (Eq. 1) whereby the structure of the present embodiment can be adapted to such a case.

For implementing it, the luminance data is monitored to detect which device is to be driven in each of the periods I, II, and III.

Specifically, since the luminance data and pulse widths are in a proportional relation, the apparatus is provided with comparing units being comparator means for comparing the magnitude of each luminance data with either of reference values based on the following criteria a to c:

a: a device driven in the period I is one with the luminance data thereof not less than 01B;

b: a device driven in the period II is one with the luminance data thereof not less than 10B; and c: a device driven in the period III is one with the luminance data thereof not less than 11B. Whereby it is feasible to acquire an ON/OFF table for the respective periods I, II, III as shown in (1) of FIG. 6, calculate voltage drops in the respective periods according to (Eq. 1) from the table, and sum them up to obtain the total of voltage drops.

The above described the method of calculating correction values in the case of four devices in each row and 2-bit display gradations shown in FIG. 3. In this case, twelve voltage drops were calculated according to 4 points×3 periods as shown in (2) of FIG. 6.

Correction values can be calculated theoretically by a similar method even with increase in the number of emitters and with increase in the number of display gradations. However, the calculation has to be carried out (the number of emitters in one row)×(the number of gradations−1) times in one horizontal interval, and there are also cases in which the apparatus is unable to be adapted thereto because of insufficient computational performance if the number of pixels of the display panel unit 107 is large or if the number of display gradations is large.

In the present embodiment, we will also explain correction value calculating methods where the number of pixels of the display panel unit 107 is large and where the number of display gradations is large.

In the present embodiment the number of calculations is decreased by two approximations below.

(Approximation 1) A plurality of adjacent column lines are grouped as one block and the correction calculation is carried out in block units.

(Approximation 2) The number of gradations used in the correction calculation (gradation steps for correction calculation) is reduced from the number of actual display gradations.

Figure 7:
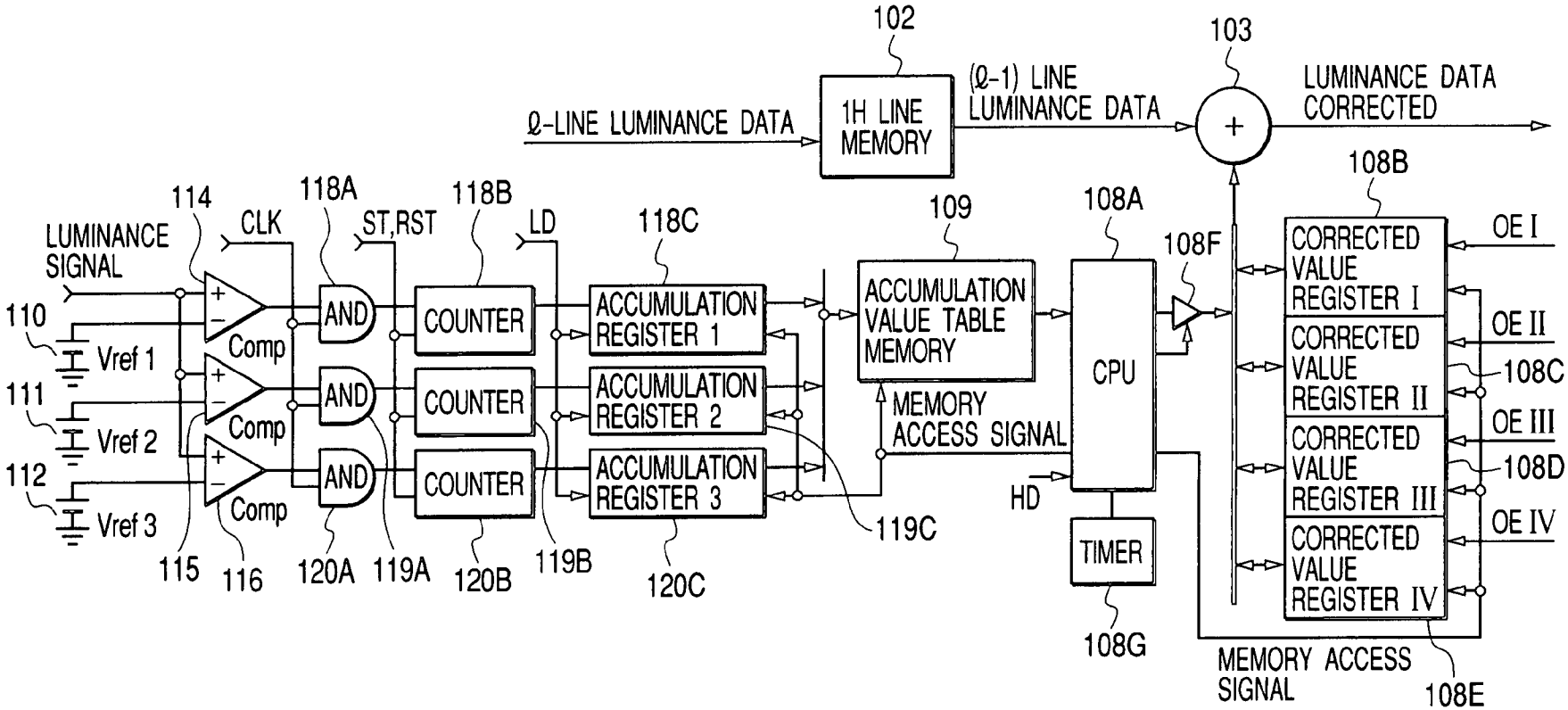
FIG. 7 is a block diagram showing a detailed example of the correction calculating unit in the display apparatus according to the first embodiment of the present invention.
Figure 8:
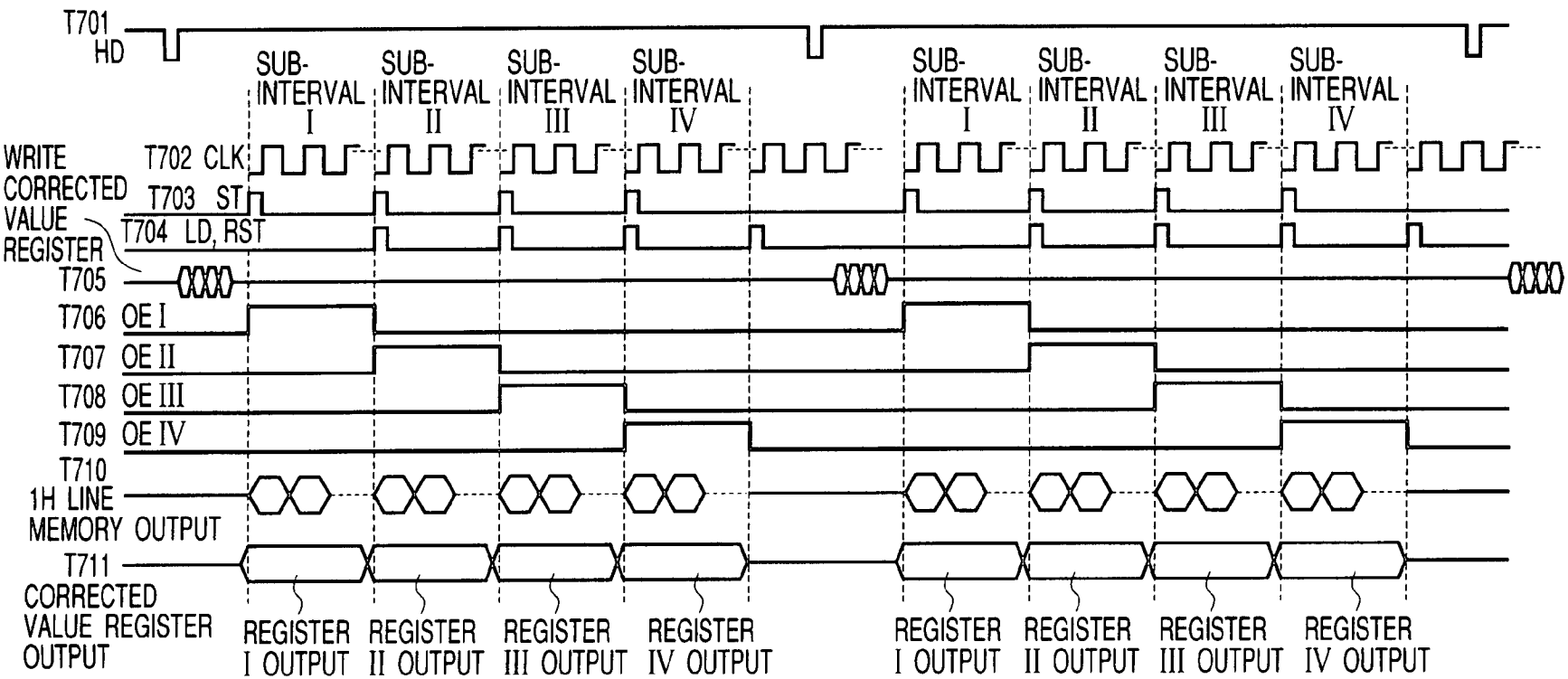
FIG. 8 is a time chart showing the operation timing of each unit in FIG. 7.

FIG. 7 is a block diagram showing the details around the correction quantity calculating unit in the first embodiment shown in FIG. 1. FIG. 8 is a time chart showing the operation timing of each unit in FIG. 7. An example of approximate calculation will be described referring to these figures.

The luminance data of the lth ($2 \leqq l \leqq m$) horizontal line is fed to the comparators 114 to 116 and to the image signal processing unit 101 not shown. The signal having been processed in the image signal processor 101 is fed to 1H line (one horizontal line) memory 102. The 1H line memory 102 acts as a delay circuit and outputs data of the (l-1)th line one line before to the adding means 103.

Figure 2:
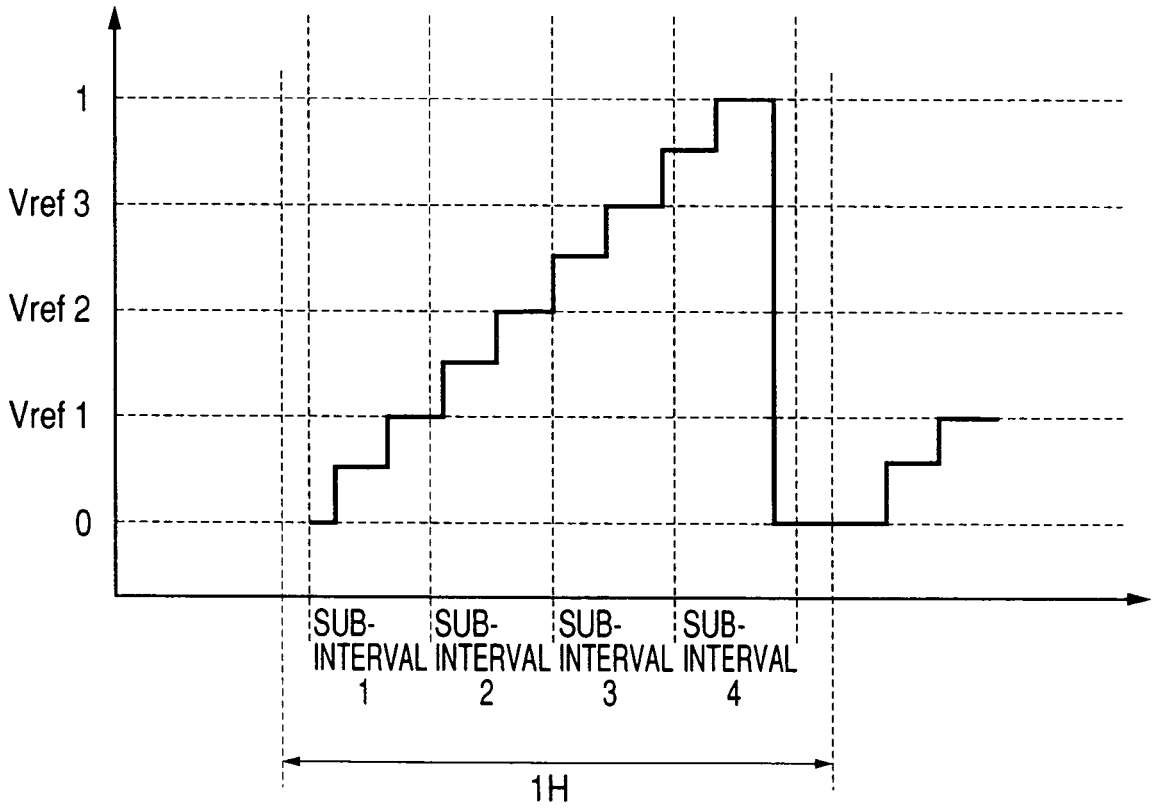
FIG. 2 is a diagram showing an example of area division and period division in the first embodiment of the present invention.

Each of the comparators 114 to 116 compares the magnitude of the input luminance data with either of reference levels Vref1 to Vref3 (110, 111, and 112) set at their respective thresholds of 0.25, 0.5, and 0.75 of the input signal level normalized as shown in FIG. 2, and provides an output of a Hi (high) level to an associated integrator 118 to 120 provided for each comparator 114 to 116 when the luminance data is greater than the reference level. The reference levels Vref1 to Vref3 corresponds to the gradation steps for correction calculation. On the drawings the reference levels using voltage sources, and the comparators as the comparing units are illustrated as if to be analog comparators for easier understanding, but it is needless to mention that the present embodiment employs digital comparators.

Each integrator 118 to 120 consists of an AND gate 118A to 120A, a counter 118B to 120B, and an accumulation register 118C to 120C. Each AND gate 118A to 120A accepts output of the comparator 114 to 116 and a CLK signal T702 and outputs a logical product signal between them to the counter 118B to 120B.

Each counter 118B to 120B counts the number of output pulses from the associated AND gate 118A to 120A during a subinterval from a rise edge of ST signal T703 to a rise edge of RST signal T704. In the present embodiment, since one horizontal interval is divided into four periods of subintervals I to IV along the direction of the time axis as in the period division shown in FIG. 2 and in the operation timing shown in FIG. 8, a rise edge of ST signal T703 is set at the timing of a start of each divisional period (subinterval) and a rise edge of RST signal T704 is set at the timing of an end of each divisional period (subinterval). These timing signals shown in FIG. 8 are generated by the timing generator 104 shown in FIG. 1.

A count value of each counter 118B to 120B is stored in the accumulation register 118C to 120C in response to an LD signal T704 set at the timing of an end of each subinterval. Although the RST signal and the LD signal are illustrated as T704 at the same timing in FIG. 8, it is a matter of course that the LD signal leads the RST signal and each counter 118B to 120B is reset after the count value is transferred to the accumulation register 118C to 120C. The count value stored in each accumulation register 118C to 120C is transferred to an accumulation value table memory 109 in response to a memory access signal from CPU 108A before a next rise edge of the LD signal.

Figure 9:
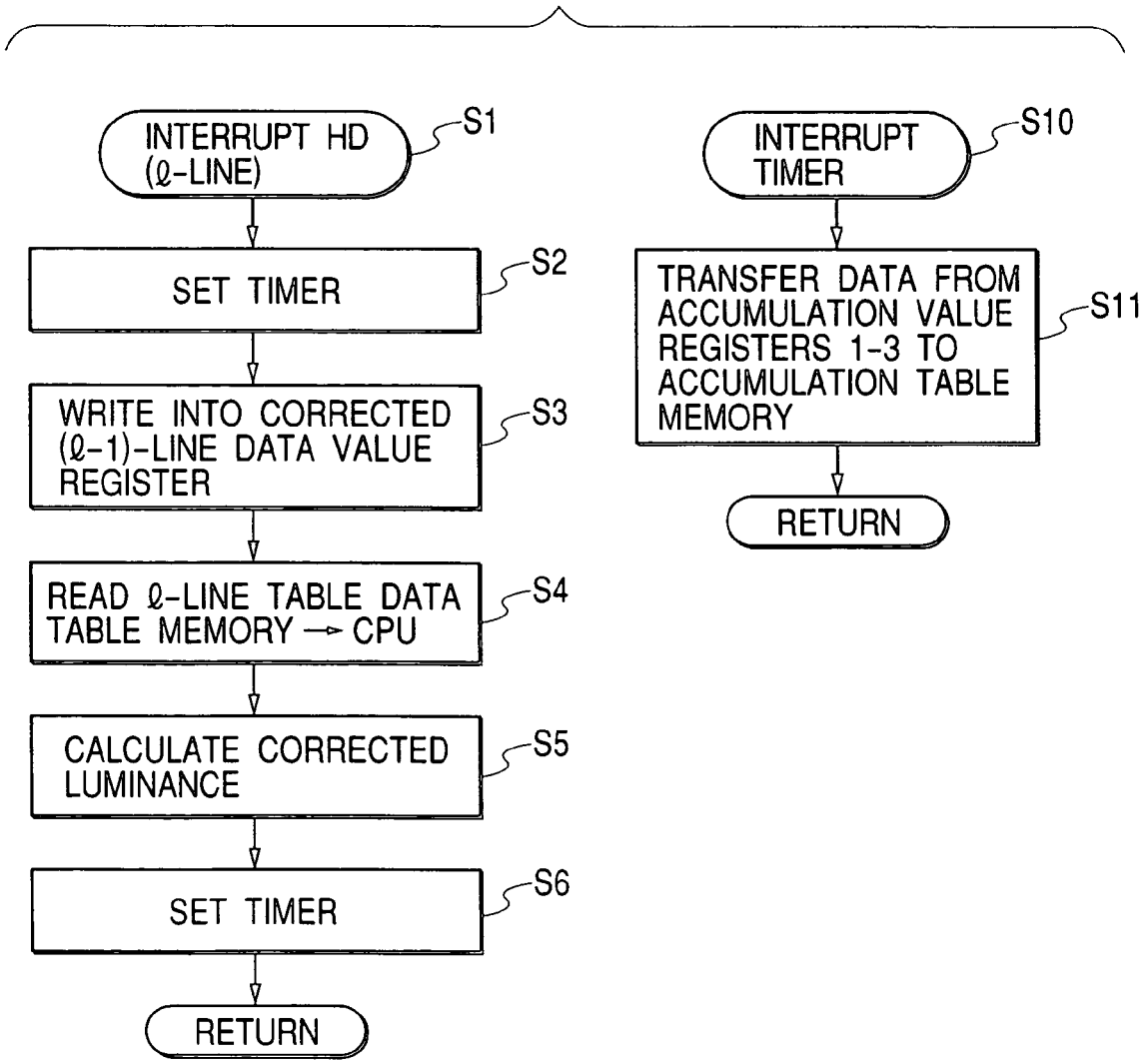
FIG. 9 is a diagram showing flowcharts associated with a CPU in FIG. 7.

The correction quantity calculating unit 108 in FIG. 1 is comprised of the CPU 108A, correction value registers 108B to 108E, a buffer 108F, and a timer 108G as shown in FIG. 7. The CPU 108A is provided with a ROM means storing programs to define the operation thereof, which is not shown, and operates according to the programs. FIG. 9 shows flowcharts of a program associated with the calculation of correction values. By an interrupt operation of HD signal T701 fed into the CPU 108A (step S1), the calculation of correction values is carried out in synchronism with the luminance data signal in horizontal interval units.

Figure 10:
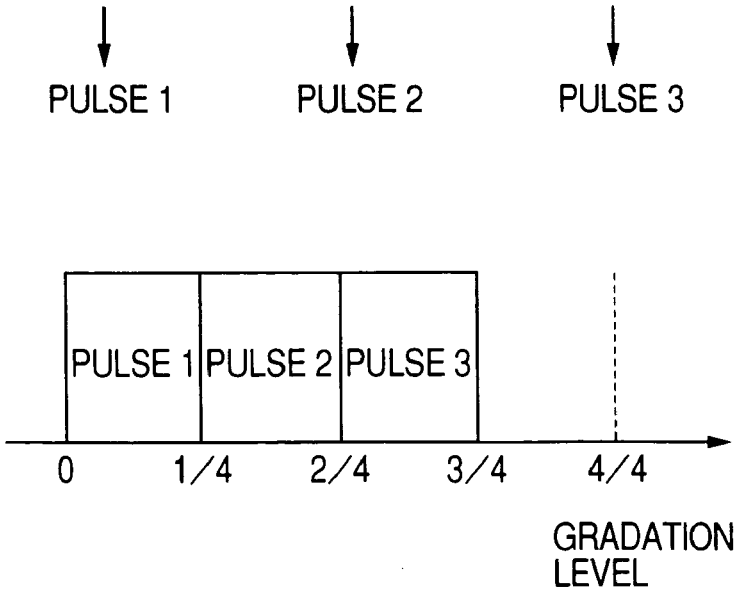
FIG. 10 is a diagram showing an example of contents of an accumulation value table memory in FIG. 7.

With occurrence of an HD interrupt event, the CPU 108A jumps to a correction calculation processing routine. In that routine the CPU 108A first sets the timer 108G (step S2). The timer 108G operates to generate several timer interrupts within one horizontal interval in the CPU 108A. With occurrence of a timer interrupt, the CPU 108A jumps to a timer interrupt routine at step S10 to transfer the data stored in the accumulation registers 1 to 3 (118C to 120C) to predetermined addresses in the accumulation value table memory 109 (the addresses being calculated according to the number of timer interrupts) (step S11). After completion of the data transfer, the CPU returns to the original routine. An example of the data in the accumulation value table memory 109 is presented in FIG. 10.

At step S3, the CPU 108A then writes the correction value data calculated in a previous horizontal interval, at the timing of T705 in FIG. 8 into the correction value registers 108B to 108E. The buffer 108F is enabled during only this write period. This writing is completed during a horizontal retrace interval of the luminance data.

The correction value registers 108B to 108E are configured so that the outputs of the correction value registers 108B to 108E are switched following the periods I to IV by OEI to OEIV signals (signals to enable the output of the register during the Hi period) indicated by T706 to T709 in FIG. 8, and they output correction value data according to the switching to the adder 103.

Figure 11:
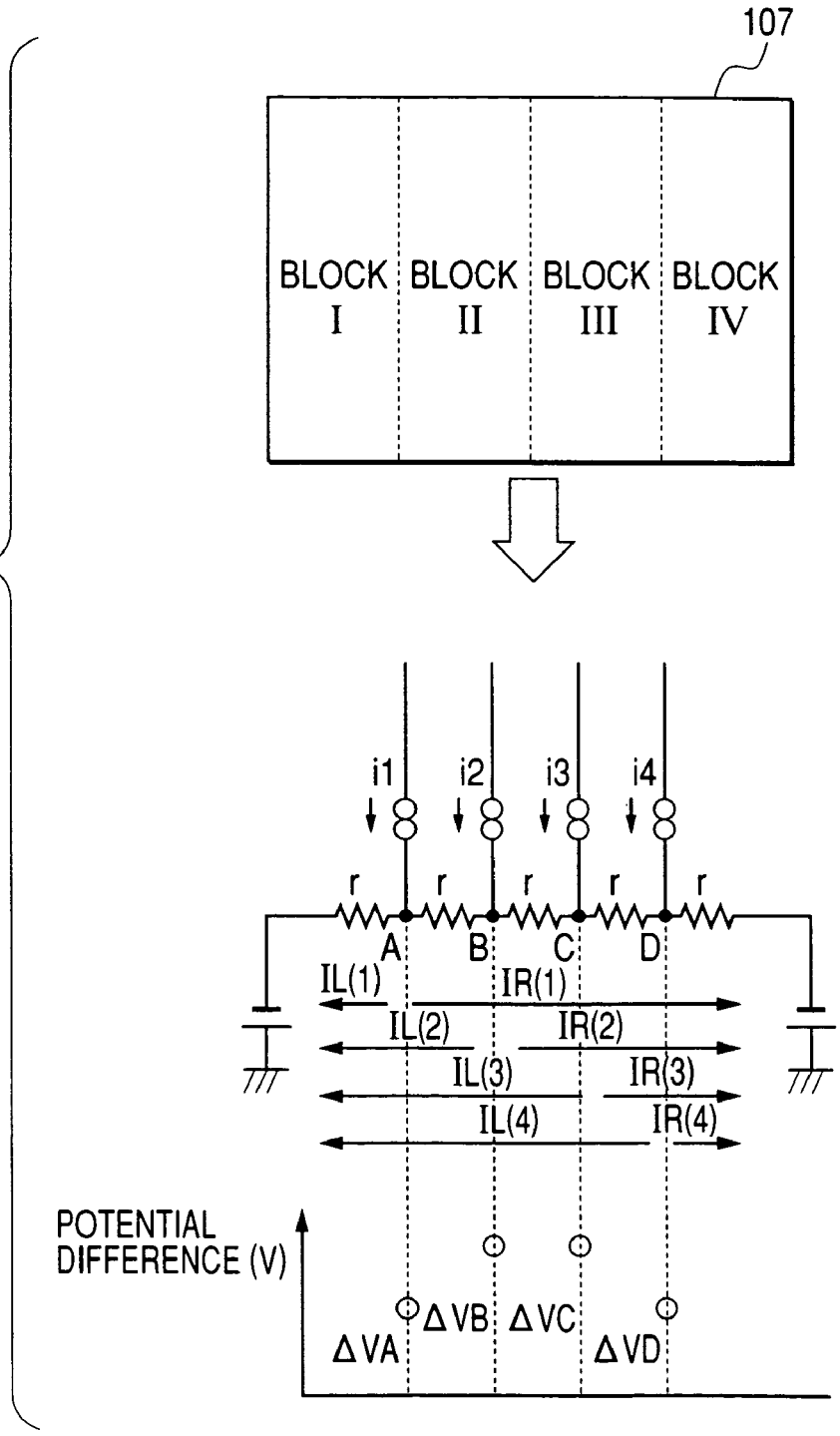
FIG. 11 is a diagram showing an example of an approximation model used in the first embodiment of the present invention.

At step S4 thereafter, the CPU 108A reads the data from the accumulation value table memory 109 and at step S5 the CPU executes the calculation of correction values according to an approximation model as shown in FIG. 11.

(Approximation 1) All the column lines of the display panel unit 107 are grouped in plural block units (four blocks in this case) and the total of drive currents flowing in respective column lines within each block is handled as a block current (equivalent to i1 to i4 in FIG. 11). Resistance values between devices on each row line are also considered by resistance values between typical points defined in respective blocks.

(Approximation 2) Column line driving pulse widths according to the luminance data are replaced by three pulses of pulses 1, 2, and 3 (approximating pulses 1, 2 and 3 corresponding to gradation steps for correction calculation) according to the following conditions a to d:

a: luminance data less than Vref1→pulse width 0 b: luminance data not less than Vref1 but less than Vref2→pulse width ¼: (pulse 1)

c: luminance data not less than Vref2 but less than Vref3→pulse width ⅔: (pulse 2)

d: luminance data not less than Vref3→pulse width ¾: (pulse 3)

The block currents for the respective pulses 1 to 3 are gained as follows according to Approximations 1 and 2. Here "i" represents a drive current value for one emitter.

$$i1(\text{pulse } 1)=NA1\times(i/4)$$

$$i1(\text{pulse } 2)=NA2\times(i/4)$$

$$i1(\text{pulse } 3)=NA3\times(i/4)$$

$$i2(\text{pulse } 1)=NB1\times(i/4)$$

$$i2(\text{pulse } 2)=NB2\times(i/4)$$

$$i2(\text{pulse } 3)=NB3\times(i/4)$$

$$i3(\text{pulse } 1)=NC1\times(i/4)$$

$$i3(\text{pulse } 2)=NC2\times(i/4)$$

$$i3(\text{pulse } 3)=NC3\times(i/4)$$

$$i4(\text{pulse } 1)=ND1\times(i/4)$$

$$i4(\text{pulse } 2)=ND2\times(i/4)$$

$$i4(\text{pulse } 3)=ND3\times(i/4)$$

Here NA1 to NA3, NB1 to NB3, NC1 to NC3, and ND1 to ND3 represent numbers of column lines having the luminance data of pulses 1 to 3 in each of the four blocks.

Since the approximation model shown in FIG. 11 is the same as the aforementioned one shown in FIG. 4, once the block currents i1 to i4 are obtained for the respective pulses 1 to 3 as described above, voltage drops (block voltage drops) for blocks can be calculated according to (Eq. 1). As described in Japanese Patent Application Laid-Open No. 8-248920, there is the known property of relation of the device applied voltage (Vf) with the device drive current (If) and emission current (Ie) and it is thus feasible to calculate decreases of emitted electrons from the voltage drops and calculate correction values for compensating for the decreases.

The correction value data obtained in this way is stored in an unrepresented memory placed around the CPU 108A and is transferred to the correction value registers I to IV upon processing of a next HD interrupt.

The adding means 103 adds the correction value data to the luminance data of the (l-1)th line and transfers the result as corrected luminance data to the column line driving unit 105. Accordingly, drive pulses outputted in one horizontal scanning interval from the column line driving unit 105 are as follows; for example, in the configuration having the row line driving units on the both sides of the display panel as shown in FIG. 1; for the same luminance data, the pulse width of voltage pulses fed to column lines in the central part of the display panel with greater voltage drops becomes longer than that at the ends. In another configuration provided with a row line driving unit on only one side of the display panel, the pulse width of drive pulses applied to column lines located apart from the row line driving unit becomes longer.

The above described the correction calculating method using the approximation example based on four column wiring blocks and three types of gradation pulses (which correspond to the gradation steps for correction calculation) for simplicity of description, but, without having to be limited to this, the number of blocks and the number of types of gradation pulses can be arbitrarily increased or decreased, of course.

In the example shown in FIG. 7, the apparatus was described using the example wherein it was provided with the correction value registers 108B to 108E in the same number as the number of blocks of column lines and wherein column line correction in an identical block was carried out by an equal value, but it is also possible to determine correction value data for each column line by linear interpolation using the correction value data obtained for the respective blocks. Namely, the voltage drops and the correction value data calculated therefrom are calculated in each column line block according to the foregoing method, and the corrected luminance data can be generated for each column line in each block, using correction value data obtained by linear interpolation from the calculated values for the respective blocks.

Further, correction value data for an arbitrary period in the periods can also be obtained similarly by linear interpolation, using the correction value data obtained in the respective periods.

Namely, the calculation of voltage drops requiring great computational complexity is carried out through blocking of the column lines and gradation steps for correction calculation and the linear interpolation requiring less computational complexity is employed to gain the correction value data for arbitrary luminance data among all the column lines.

It is needless to mention that the correction for luminance can be implemented with higher accuracy by provision of interpolating means for carrying out the interpolation of the correction value data as described above.

The above example was described by the configuration of uniform block division in (Approximation 1), but the way of division does not always have to be limited to this, of course; for example, the size of the block in the central portion may be different from that in the peripheral portion of the display panel unit 107.

Second Embodiment

Figures 14, 15:
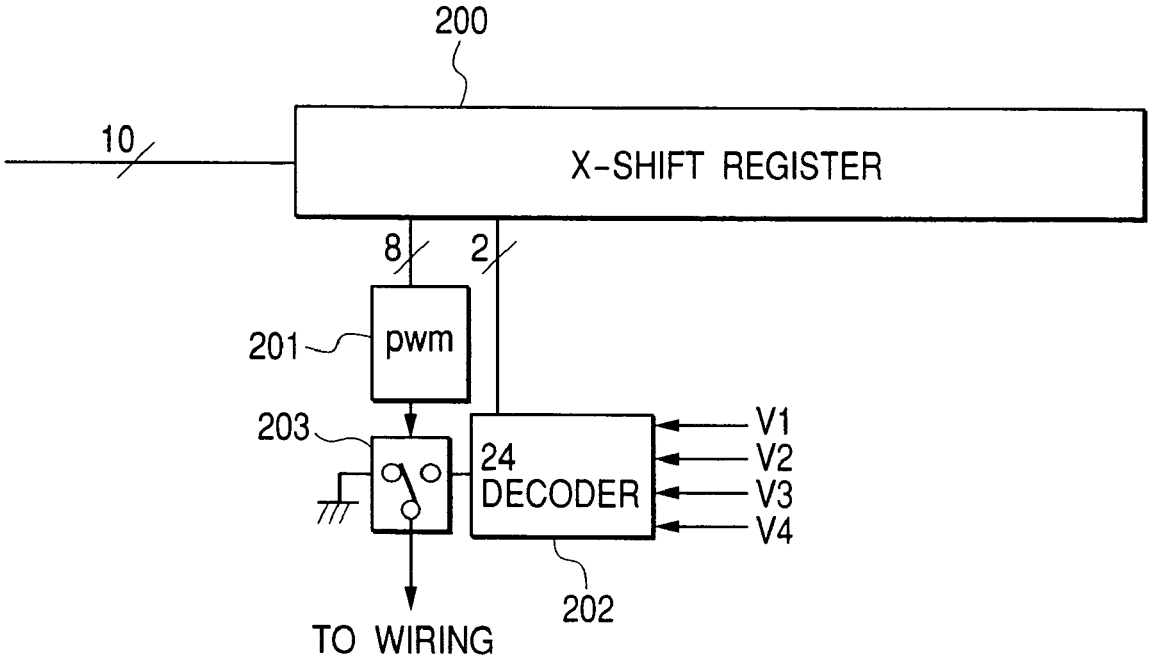
FIG. 14 is a diagram showing a configuration of one column part of the column line driving unit in the second embodiment of the present invention.
FIG. 15 is a table showing an output table of a decoder in FIG. 14.

FIG. 14 is a block diagram showing the column line driving unit for one column line part used in the second embodiment of the present invention. Although not shown, the column line driving units are provided for the respective column lines in fact.

In this embodiment, the bit width of data fed to the X-shift register 200 is considered to be ten bits. The reason for the 10-bit width is that the luminance data is assumed as data of eight bits and the correction value data as data of two bits. The X-shift register 200 has the depth of (the 10-bit width)×(the number of column lines). The pulse width modulator 201 associated with this embodiment has the same function as the pulse width modulators 105B described in the first embodiment, and in this case the pulse width modulator 201 accepts 8-bit input of the luminance data and outputs a trigger signal with a pulse width equivalent to either of 0 to 255 gradations according to the luminance data, to SW (switch) means 203.

The 2-bit correction value data is fed to a decoder 202, and the decoder 202 determines one of four types of voltages (V1 to V4) fed from an unrepresented power supply unit, based on the correction value data, and outputs it. The determination is implemented, for example, as in the table shown in FIG. 15. The SW means 203 is a switching means for switching the voltage applied to the column line to an output voltage from the decoder 202 or to a voltage of the ground level in response to a trigger signal from the pulse width modulator 201, and applies the output voltage from the decoder 202 to the column line during a period of the pulse width according to the luminance data.

Figure 12:
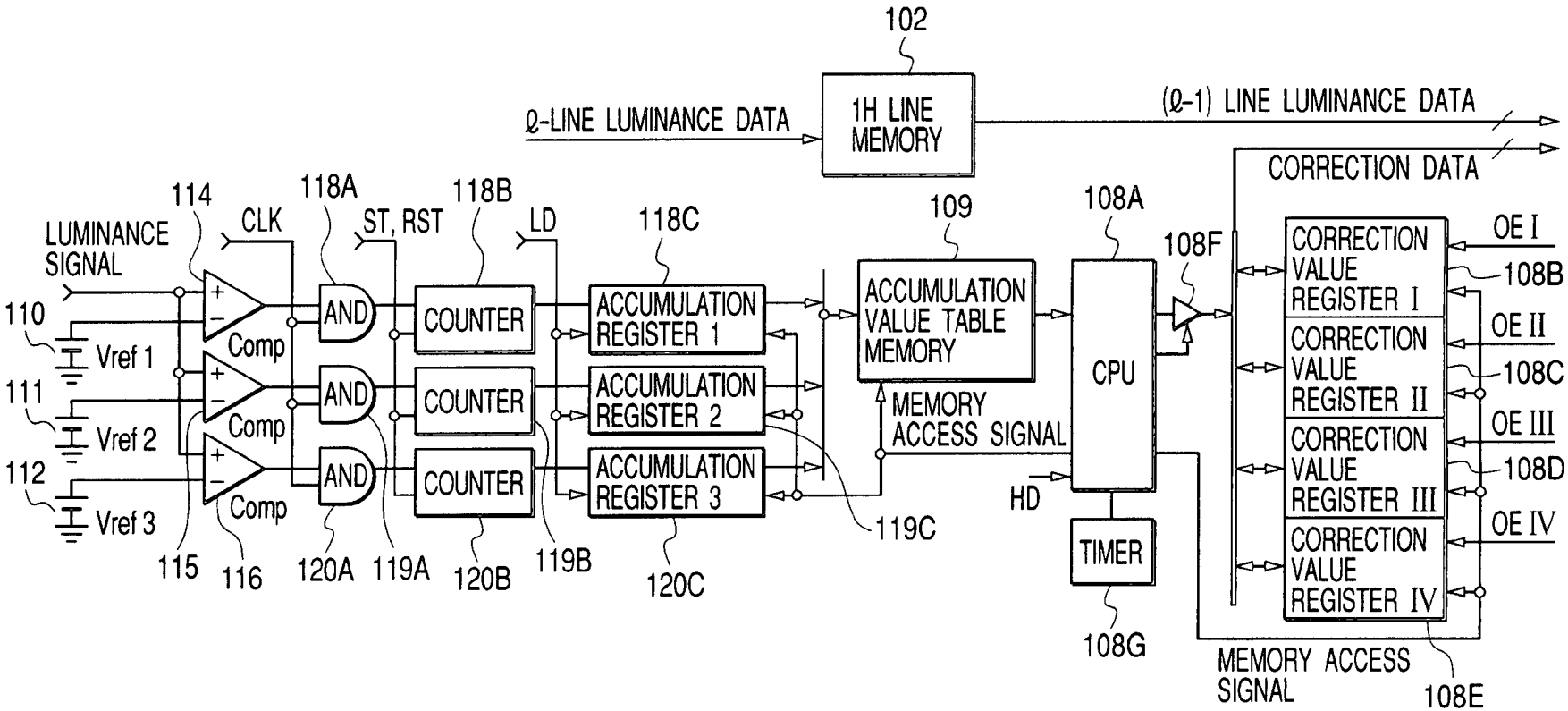
FIG. 12 is a block diagram showing a display apparatus according to the second embodiment of the present invention.
Figure 13:
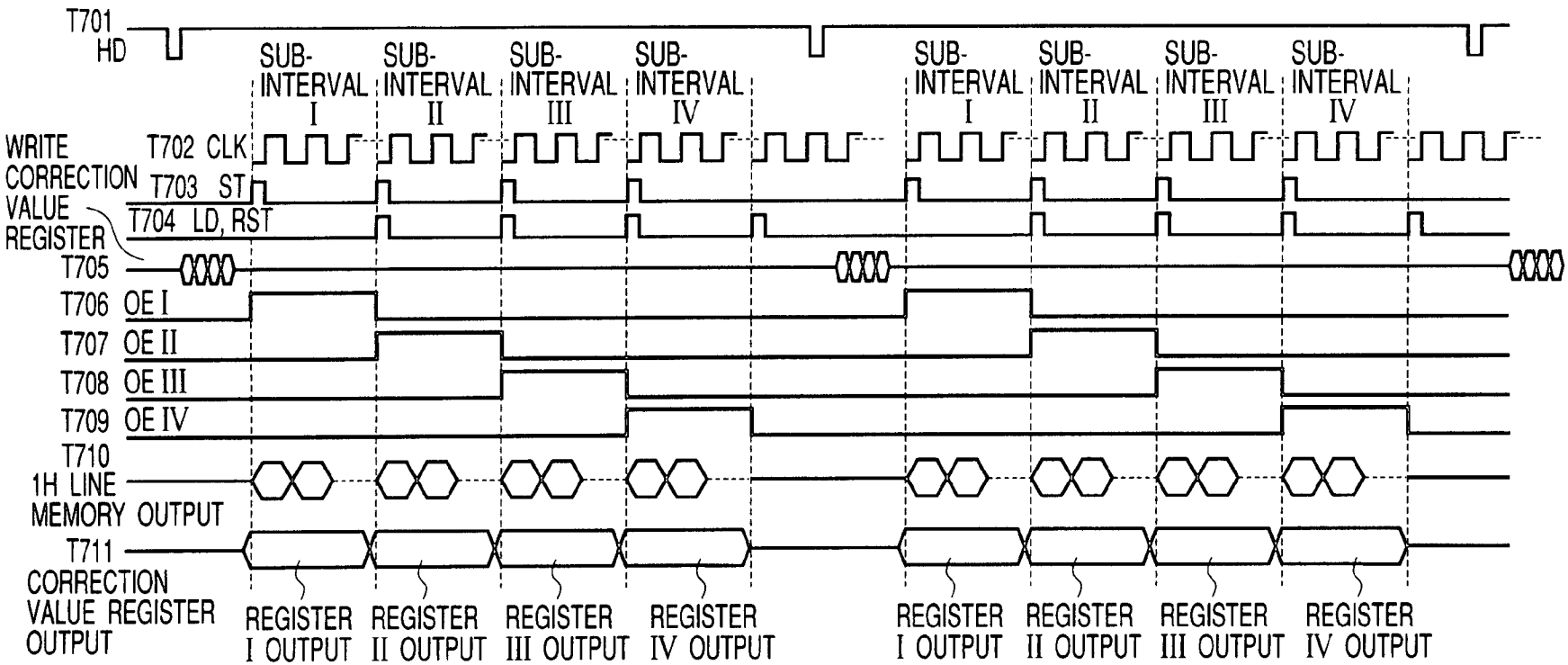
FIG. 13 is a time chart showing the operation timing of each unit in FIG. 12.

FIG. 12 shows a configuration of the correction quantity calculating unit in the second embodiment of the present invention and FIG. 13 shows the operation timing thereof.

In the present embodiment the operations up to those of calculating correction values and writing them into the correction value registers I to IV are substantially the same as in the first embodiment. In the first embodiment the adding means 103 performed the addition process of the luminance data and correction value data and outputted the result, whereas in the second embodiment the signals are sent through separate signal lines to the respective X-shift registers 200. In the example of the output stage configuration shown in FIG. 14, the luminance data was of eight bits and the correction value data of two bits. However, the data does not have to be limited to this example, of course. The second embodiment is different from the first embodiment in that the correction is implemented by switching the decoder 202 of the output unit according to the correction value data and thereby changing the drive voltage applied to the electron-emitting device.

In the present embodiment it is also possible to increase the number of correction value registers so as to be greater than the number of approximate blocks for the calculation of correction values. For the thus increased registers, values to be written therein are determined by linear interpolation using the correction value data obtained in the respective blocks and the resultant values are stored in the respective registers.

Third Embodiment

Figure 16:
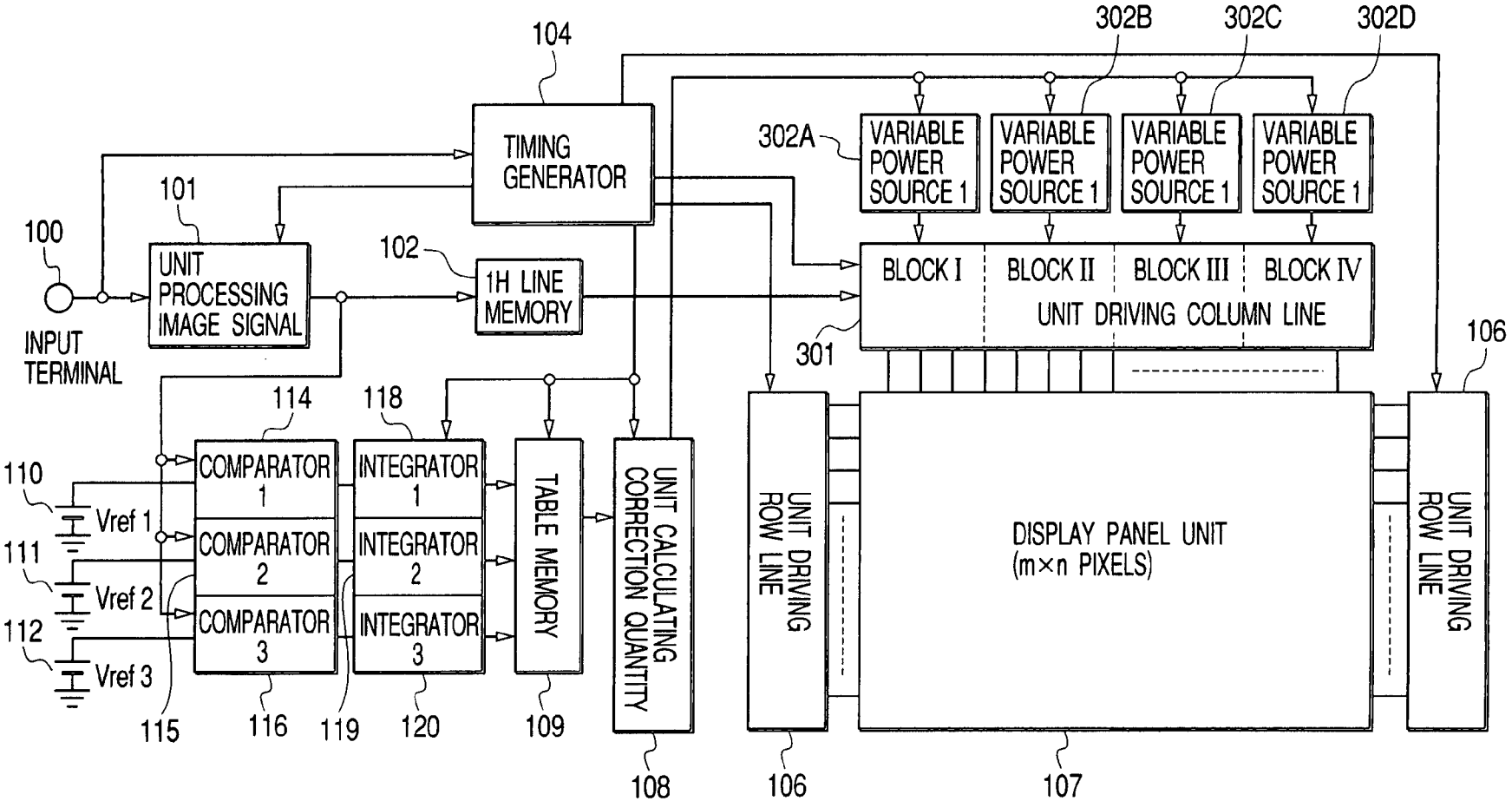
FIG. 16 is a block diagram showing a display apparatus according to the third embodiment of the present invention.
Figure 17:
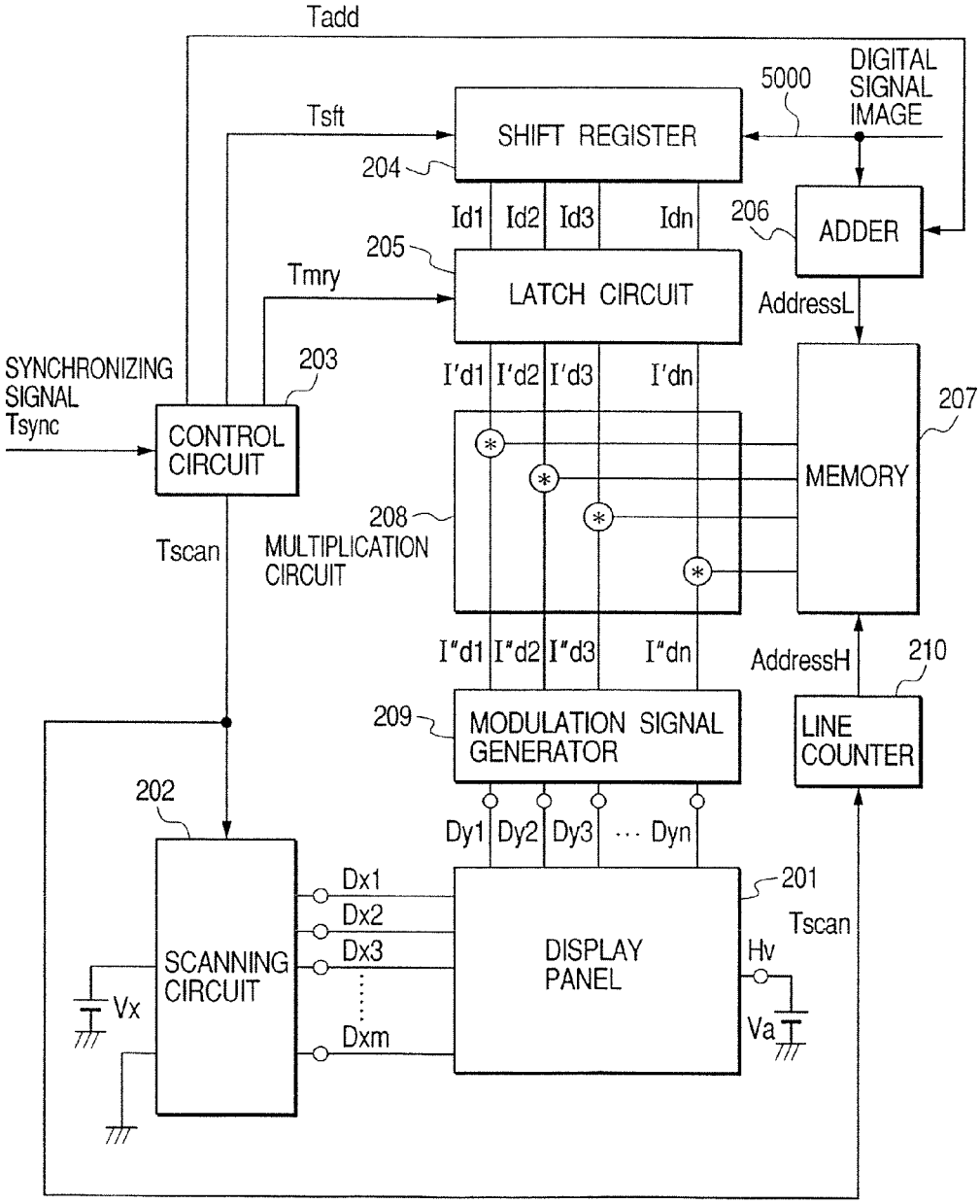
FIG. 17 is a block diagram showing the display device described as the first embodiment in Japanese Patent Application Laid-Open No. 8-248920 cited as the conventional example.

FIG. 16 is a block diagram showing the display apparatus according to the third embodiment of the present invention.

In the present embodiment the operations up to those of calculating the correction values and writing them into the correction value registers I to IV are substantially the same as in the first embodiment. A difference from the first embodiment is how to supply the correction values to the column line driving unit.

The column line driving unit 301 has substantially the same configuration as in the first embodiment but is different in the function of column line driving output units 205C. In the first embodiment they operate to amplify the output voltage signals from the pulse width modulators 105B to the desired amplitude level and apply the amplified signals to the column lines, whereas in the present embodiment they operate to make amplitude levels applied to the column lines, equal to voltage values supplied from the outside.

In the example shown in FIG. 16, variable power sources 302A to 302D are provided for the respective approximate blocks I to IV for the calculation of correction values, and pulses with voltage amplitudes determined by the variable power sources 302A to 302D are applied to the column lines.

Output voltages from the variable power sources 302A to 302D are controlled by a signal from the correction quantity calculating unit 108. For example, the variable power sources 302A to 302D can be constructed of digital-analog converter means (hereinafter called DA means). In this case, the operation may be arranged so that the correction value data written in the correction value registers in FIG. 7 is transferred to the DA means during a retrace interval and voltages determined by the correction value data are outputted during an effective period.

In the present embodiment it is also possible to increase the number of correction value registers so as to be larger than the number of blocks for the calculation of correction values. For the increased registers, values to be written therein are determined by linear interpolation using the correction value data calculated in the respective blocks, and the results are stored in the respective registers. In addition, variable power sources 302X need to be added in similar fashion.

As described above, the present invention enables the compensation for the decrease of luminance caused by the decreases of drive voltage of the devices due to the electric resistance of electric connection wiring and the like to the image forming devices such as the electron-emitting devices, the EL devices, or the like, thereby implementing uniform and excellent image display across the entire display screen.

Further, in implementation of the correction, the invention permits the correction to be implemented by smaller-scale hardware than before, by introducing at least either one of the two types of approximations even in configurations with the large number of pixels of the display panel and with the large number of display gradations. Therefore, the invention allows reduction of production cost.

What is claimed is:

1. Display apparatus comprising:

a display panel comprising electron-emitting elements of cold cathode electron source type driven through a plurality of row and column lines as pixels arranged in a matrix form;

an input unit adapted to input a video signal from an external video source, an image processing unit adapted to transform the video signal to a luminance data for luminously driving respective pixels through the column lines so as to be adaptable to the specifications of the display panel;

a memory in response to the luminance data for temporarily storing the luminance data for pixels;

a calculation unit, responsive to the luminance data for calculating a correction value for the luminance data, wherein the calculation unit defines a plurality of blocks each of which includes a plurality of column lines and a plurality of periods divided in one horizontal scanning period, and wherein for each of subperiods divided in one horizontal scanning period, the calculation unit calculates a voltage drop in the subperiod to generate the correction value for a respective one of the plurality of blocks according to calculated voltage drops in respective ones of the subperiods, the calculation unit calculates the voltage drop in the subperiod based on a formula that is a function of a resistance value of a respective one of the row lines and currents estimated to flow through the column lines in the plurality of blocks during the subperiod when the luminance data is applied by way of the respective row line to the column drive unit for driving all of the column lines during one horizontal scanning period, and a circuit adapted to combine the temporarily stored luminance data of each of the row lines of the respective one of the plurality of blocks with the correction value generated for that block by using adder, to produce the corrected luminance data for each of the row lines of that block;

a column line drive unit in response to the corrected luminance data for applying to each of the plurality of column lines a signal pulse of a width corresponding to the corrected luminance data; and a row line drive unit for sequentially selecting and scanning the plurality of row lines.

2. Display apparatus according to claim 1, wherein each of the blocks includes at least two neighboring column lines.

* * * * *